US009233736B2

(12) United States Patent
Busson

(10) Patent No.: US 9,233,736 B2
(45) Date of Patent: Jan. 12, 2016

(54) INSTALLATION FOR ANCHORING A FLOATING PLATFORM TO THE GROUND

(71) Applicant: NOV-BLM, Carquefou (FR)

(72) Inventor: Philippe Busson, Nantes (FR)

(73) Assignee: NOV-BLM, Carquefou (FR)

( * ) Notice: Subject to any disclaimer, the term of this patent is extended or adjusted under 35 U.S.C. 154(b) by 83 days.

(21) Appl. No.: 14/353,877

(22) PCT Filed: Oct. 26, 2012

(86) PCT No.: PCT/FR2012/052468

§ 371 (c)(1),
(2) Date: Apr. 24, 2014

(87) PCT Pub. No.: WO2013/061000

PCT Pub. Date: May 2, 2013

(65) Prior Publication Data

US 2014/0286711 A1 Sep. 25, 2014

(30) Foreign Application Priority Data

Oct. 26, 2011 (FR) ..... 11 59706

(51) Int. Cl.

| | |
|---|---|
| ***B63B 21/16*** | (2006.01) |
| ***B63B 21/24*** | (2006.01) |
| ***E02D 5/74*** | (2006.01) |
| ***B63B 35/44*** | (2006.01) |
| ***B63B 21/50*** | (2006.01) |
| ***B63B 21/26*** | (2006.01) |

(52) U.S. Cl.

CPC ..... *B63B 21/16* (2013.01); *B63B 21/24* (2013.01); *B63B 21/26* (2013.01); *B63B 21/50* (2013.01); *B63B 35/44* (2013.01); *E02D 5/74* (2013.01); *B63B 2021/505* (2013.01)

(58) Field of Classification Search

CPC ..... B63B 21/16; B63B 21/50; B63B 21/502; B63B 2021/203; B63B 2021/505

See application file for complete search history.

(56) References Cited

U.S. PATENT DOCUMENTS 2,986,889 A * 6/1961 Ludwig ..... 405/224
3,540,396 A * 11/1970 Horton ..... 114/265

(Continued)

FOREIGN PATENT DOCUMENTS

| | | |
|---|---|---|
| GB | 2 166 106 | 4/1986 |
| WO | 98/33700 | 8/1998 |

OTHER PUBLICATIONS

International Search Report dated Jan. 16, 2013, corresponding to PCT/FR2012/052468.

*Primary Examiner* — Tara M. Pinnock
(74) *Attorney, Agent, or Firm* — Young & Thompson

(57) ABSTRACT

A system for anchoring to the ground, via chains, a floating platform, whose operating station includes:

activatable/deactivatable stopper elements for each of the anchor chains, for locking in position the associated chain that ends by an upstream free strand including an end connection chain link, wherein the stopper elements are arranged side by side, along a same line, and are each associated with one housing-reservoir for storing the upstream free strand of the associated chain; and tensioning elements common to the different chains, and including a single tensioning winch, movably mounted above the stopper elements, wherein the tensioning winch includes a master chain strand, whose downstream end includes a downstream chain link adapted to be removably attached to the connection chain link of the upstream free strand of the anchor chains, and whose upstream end is stored in a container-reservoir.

15 Claims, 6 Drawing Sheets

(56) References Cited

U.S. PATENT DOCUMENTS 4,020,779 A * 5/1977 Kitt ..... 114/293
5,779,226 A 7/1998 Wudtke
5,984,586 A * 11/1999 Wudtke ..... 405/224
7,044,685 B2 * 5/2006 Wybro et al. ..... 405/207
2011/0293379 A1 * 12/2011 Halkyard et al. ..... 405/224

* cited by examiner

INSTALLATION FOR ANCHORING A FLOATING PLATFORM TO THE GROUND

The present invention relates to the systems for anchoring floating platforms, in particular for anchoring to the ground oil-well exploitation platforms or floating production storage and offloading vessels (also known as FPSO).

Conventionally, offshore oil-well exploitation platforms consist in floating supports connected to the wellhead and anchored to the ground by means of anchor chains.

Such platforms, generally square in horizontal cross-section, may have sides of several tens of meters long and their weight may reach several tens of thousands of tons, or even several hundreds of thousands of tons.

They support all the means required for oil extraction, and possibly on-site processing, and sometimes equipments intended to ensure a human presence on board.

For the anchoring thereof, several groups of a plurality of parallel chains (three to eight chains per group, for example), also referred to as ground tackles, are very generally used, with each group being arranged at one of the corners of the platform.

Each anchor chain consists in a chain of metal links, each of which is a few tens of centimeters long (made from a wire of 9 to 20 cm in diameter, for example).

The lower ends of each of the anchor chains comprise means for being fastened to the ground, through a block embedded in the sea floor. Their upper ends extend up to an operating station that is arranged on the side of the platform, above the waterline of the latter, for being operated by a respective tensioning winch associated with activatable/deactivatable stopper means.

And between the upper and lower ends, an intermediate area of the chains is associated with a bending device, called a fairlead, which is fastened to the platform, generally under the waterline level.

From the operating station, the chains extend vertically along the platform, down to each associated fairlead, and then they extend obliquely down to their respective ground-anchoring block.

The tension of each chain is adjusted by the tensioning winch associated therewith, and the upstream free strand, which extends behind the tensioning winch falls under gravity in a container-reservoir adapted for the storage thereof.

Once correctly tensioned, the chains are locked in position by the stopper means. These stopper means can be provided just downstream the tensioning winches and/or at the bending fairleads.

But the present anchor systems are relatively complex because of the required multiplication of chains, bending fairleads, stoppers and tensioners. Therefore, they are relatively expensive and their weight may be very high (sometimes up to several thousands of tons), which limits the load-carrying capacity.

The present invention aims to remedy these drawbacks by proposing an original structure of anchor system that, while keeping optimal anchor characteristics (in terms of fastening and strength), is of simpler design and is lighter in weight than the present systems. Moreover, such system has improved operation ergonomics.

For that purpose, the corresponding anchor system is of the type comprising at least one group formed of a plurality of juxtaposed anchor chains, arranged parallel or substantially parallel to each other, and an operating station, the lower end of each of said chains comprising means for fastening to the ground, the upper end thereof extending up to the operating station arranged on said platform, above the waterline thereof, and an intermediate area of each of said chains, between the lower and upper ends thereof, cooperating with a bending device secured to said platform, advantageously under said waterline, said operating station comprising means for tensioning said chains and means for storing the free end thereof, upstream said tensioning means.

And according to the present invention, said operating station comprises:

- activatable/deactivatable stopper means for each of said chains, for locking in position the associated chain that ends by an upstream free strand comprising an end connection chain link, wherein said stopper means are arranged side by side, along a same line, and are each associated with one housing-reservoir for the storage of said upstream free strand of the associated chain, and
- tensioning means common to the different chains, wherein said tensioning means comprise a single tensioning winch, movably mounted above said stopper means, parallel to said line of stopper means, wherein said tensioning winch comprises a master chain strand, (i) whose downstream end comprises a downstream chain link adapted to be removably attached to said connection chain link of the upstream free strand of said anchor chains, and (ii) whose upstream end is stored in a container-reservoir.

Such a system, with a single tensioning winch that can be moved at will to generate the tension of the different anchor chains, one after the others, provides simplification of the general design of the anchor system, while limiting the production cost thereof and substantially reducing the weight thereof.

According to another feature of the invention, the tensioning winch is mounted on a rolling frame, guided by a rail structure arranged on a rolling track parallel to said line of stopper means; wherein said rolling frame is associated with driving means for moving it along said line of stopper means, so as to position it above each of said stopper means, and to ensure the operation of the associated anchor chain, after connection of the downstream chain link of the master chain of said tensioning winch with the connection chain link of said associated anchor chain.

The driving means of the rolling frame of the tensioning winch advantageously consist of a motorized pinion integral with the rolling frame, cooperating with a rack extending along the rolling track.

According to a preferred embodiment, the rotation axis of the tensioning winch extends parallel to the rolling track; wherein the vertical downstream end of the master chain strand that cooperates with said tensioning winch extends in a vertical plane passing through the stopper means and through the associated housings-reservoirs; and the vertical upstream end of said master chain strand that cooperates with the tensioning winch extends in a vertical plane passing through the associated storage container-reservoir.

Still according to a preferred embodiment, the container-reservoir for the storage of the upstream end of the master chain strand—is fixedly mounted at the operating station and—extends over the whole length of the rolling track; wherein said container-reservoir comprises an upper opening for the passage of the master chain strand, said upper opening extending over the whole length, or almost the whole length, of said rolling track.

According to an alternative embodiment, this container-reservoir for the storage of the upstream end of the master chain strand is carried by the rolling frame of the tensioning winch.

According to another feature, the housings-containers for the storage of the upstream free strands of the anchor chains are arranged in the plane of the line of stopper means.

Within this framework, each housing-reservoir advantageously comprises an upper opening associated with a lateral bearing table, arranged in the continuation of said upper opening, wherein said bearing table comprises a notch, open opposite said upper opening, for the passage of a chain link of said upstream free chain strand, and the locking of the directly upstream chain link, bearing on said table.

The connection chain link of the upstream free strand of the anchor chains preferably consists in a removable chain link, for example of the type known as a "Kenter chain link".

According to still another feature, the rolling frame on which is mounted the tensioning winch carries an additional winch providing in particular the opening operations of the chain stopper located in the bending fairlead immersed directly below said tensioning winch.

The invention will be further illustrated, without being limited thereby, by the following description of a particular embodiment, given only by way of example and shown in the appended drawings in which.

Figure 1:
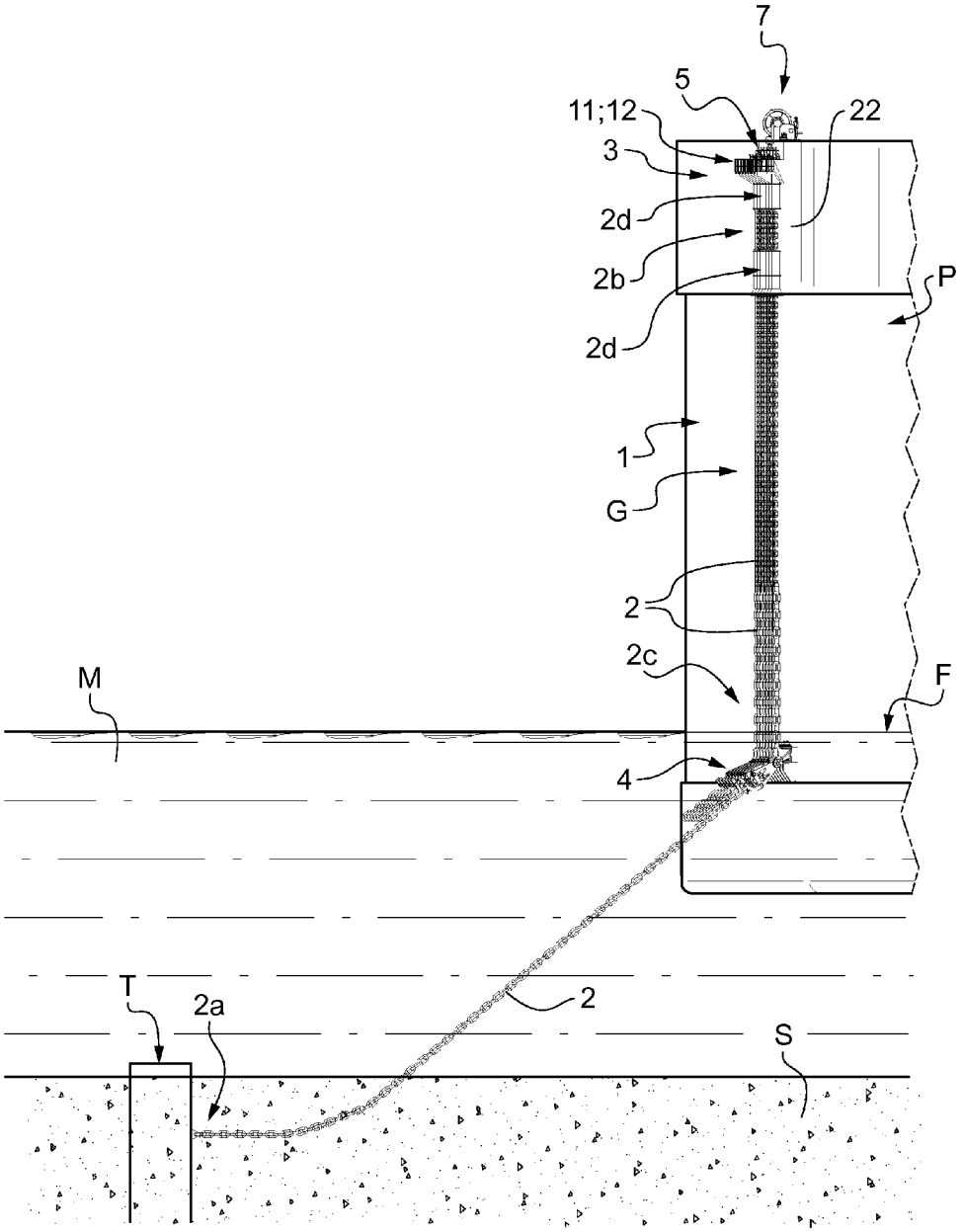
FIG. 1 is a schematic view, in slight perspective, of the anchor system according to the invention.
Figure 2:
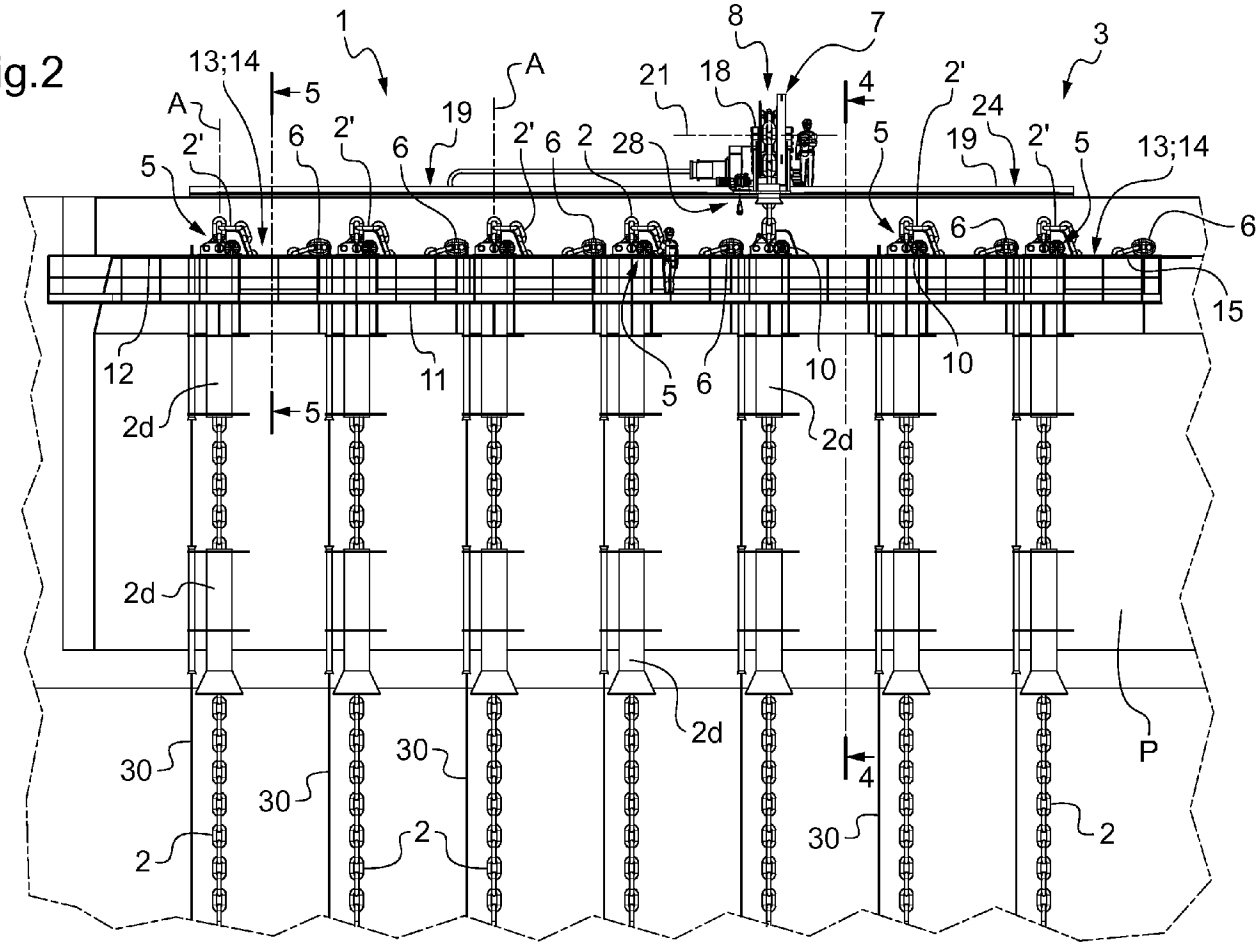
FIG. 2 is an enlarged front view of the upper part of the anchor system of FIG. 1.
Figure 3:
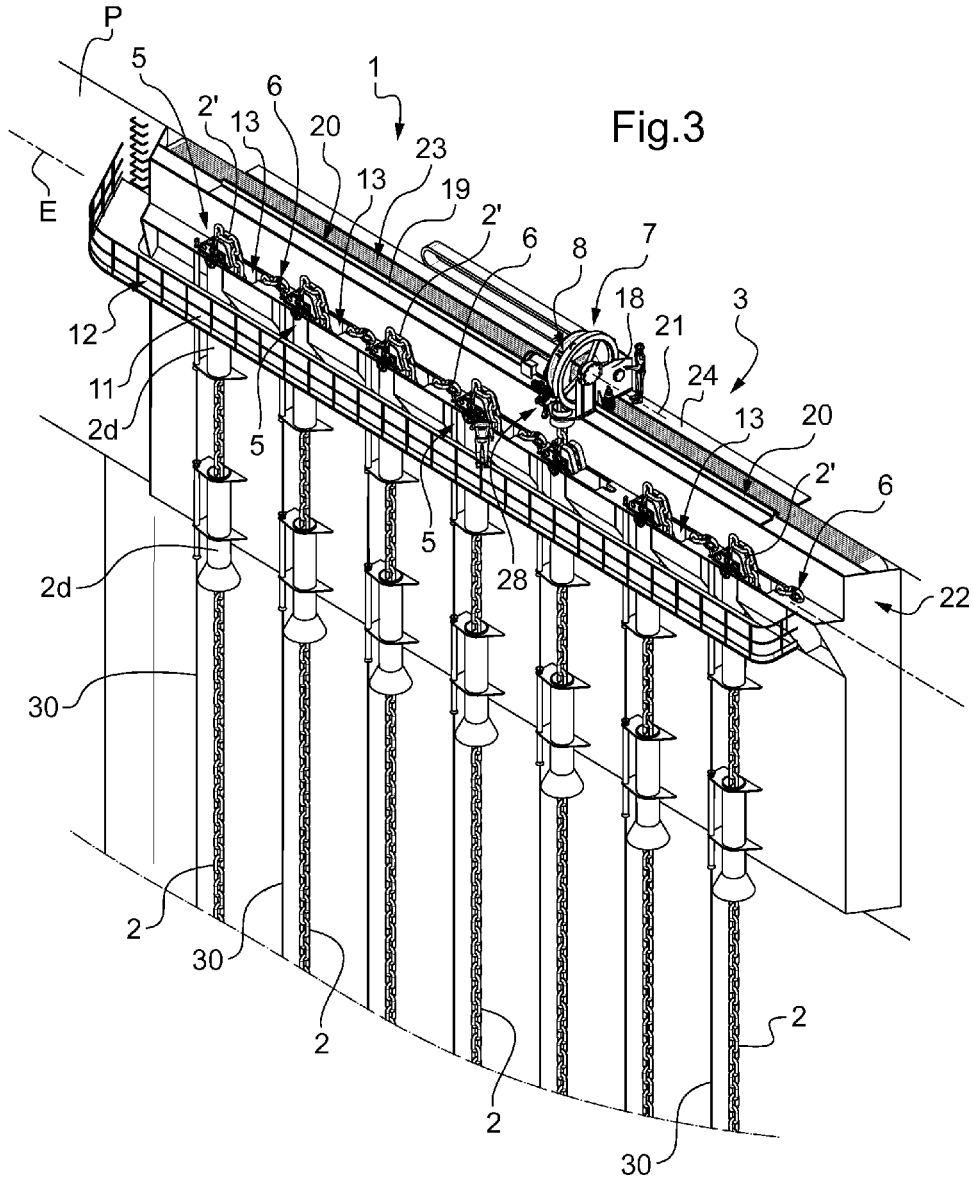
FIG. 3 is a perspective view of the part of system illustrated in FIG. 2.
Figure 4:
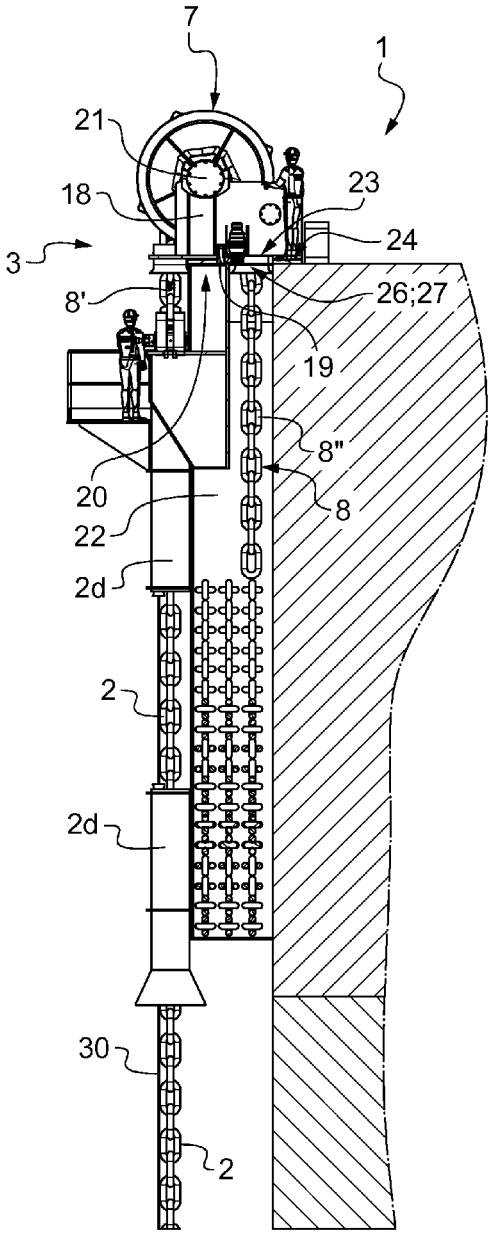
FIG. 4 is a cross-sectional view of the anchor system, taken along the sectional plane 4-4 of FIG. 2.
Figure 5:
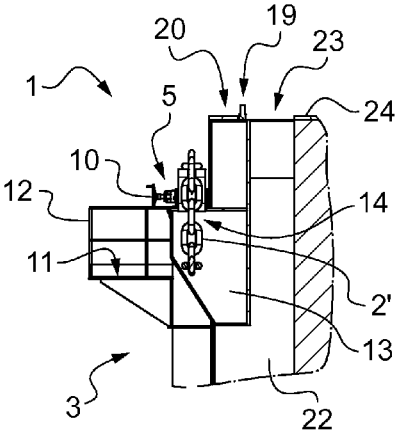
FIG. 5 is a cross-sectional view of the anchor system, taken along the sectional plane 5-5 of FIG. 2.

As illustrated in FIG. 1, the floating platform P, for example an oil platform, is anchored to the ground by means of an anchor system generally denoted 1.

Herein, the platform P is shown only partially; the system 1 for anchoring it to the ground consists of several groups of a plurality of anchor chains 2, each of these groups being for example arranged at one of the corners of the platform P (in FIG. 1, only one of these groups G of anchor chains 2 is shown).

The platform P floats on the mass of water M, above the sea floor ground S, defining a waterline F.

In the illustrated embodiment, the group G consists of seven juxtaposed anchor chains 2, arranged parallel or substantially parallel to each other, each formed of a juxtaposition of intertwined chain links.

The corresponding chain links are steel links, whose length may be of the order of 50 to 120 cm and whose width may be of the order of 30 to 80 cm, made from a wire whose diameter is comprised for example between 9 and 20 cm.

The downstream lower end 2*a* of the anchor chains 2 is fastened by any appropriate means to a block T put on the ground S of the sea floor, or preferably embedded in this ground S (in FIG. 1, only the lower end 2*a* of one of the chains 2 is shown).

The upstream upper end 2*b* of the different chains 2 extends up to an operating station 3 that is arranged on the platform P, above the waterline F, and in this case, at the upper part of said platform P.

At this operating station 3, there are notably means for tensioning the chains 2 and stopper means for locking this tension, as described in detail hereinafter.

On the other hand, an intermediate area 2*c* of each chain 2, located between the lower end 2*a* and upper end 2*b* thereof, cooperates with a bending fairlead 4, fastened to the side of the platform P, herein under the waterline F.

The different bending fairleads 4 make is possible to move, under the waterline F, the point from which the chains 2 deviate from the platform P, as illustrated in FIG. 1.

The bending fairleads 4 may comprise a stopper means for locking the tension of the associated chain 2, equipped with control means in active or inactive position, which can be operated from the operating station 3.

From this operating station 3, the anchor chains 2 extend vertically or substantially vertically down to the line of bending fairleads 4; from this line of fairleads 4, the chains 2 extend down to the block T, for example according to an angle of the order of 45° with respect to the horizontal. On the vertical part thereof, the chains 2 may be associated with guiding chute sections 2*d* (seen in FIGS. 1 to 4 and 6, 7).

The operating station, shown in detail in FIGS. 2 to 7, is equipped, according to the invention, with:

- stopper means 5 for each of the chains 2, downstream of which said chains 2 extends according to a vertical axis A toward the respective bending fairleads 4 thereof, and upstream of which extends an upstream free strand 2' of chain 2, comprising an end chain link 6, and
- means in the form of a single tensioning winch 7, movably mounted above the stopper means 5, for tensioning the different chains 2 by means of a master chain strand 8.

The stopper means 5 that equip each chain 2, and that are arranged on each vertical axis A consist in mechanisms of the type having two grip jaws 9 articulated in rotation around horizontal axes and operable in opposite directions with respect to each other by means of an operation wheel 10.

This wheel 10, operable by an operator, makes it possible to:

- bring closer together the two free ends of the grip jaws 9 to place them in an active, locking position, pressed against the chain 2 under one of the chain links thereof, or
- spacing apart these two ends of grip jaws 9, to place them in an inactive position, in which they are no longer in contact with the chain 2.

The different stopper means 5 are arranged on a same horizontal line E (FIG. 3) that extends along one side of the platform P and that is lined by a walking path 11 for the operators to move around, which is equipped with protective barriers 12.

Moreover, each stopper means 5 comprises its own housing-reservoir 13 for the storage of the upstream free strand 2' of the associated chain 2. Each housing-reservoir 13 is arranged on the side of the associated stopper means 5; and the different housings-reservoirs 13 are placed on the above-mentioned horizontal line E of stopper means 5.

These housings-reservoirs 13 each consist of a box that is delimited by a bottom and by side walls and that has an upper opening 14 on the side of which is arranged a horizontal bearing table 15.

The different bearing tables 15 are also arranged on the horizontal line E of stopper means 5, herein on the other side of the opening 14 with respect to the associated stopper means 5.

The opening 14 and the bearing table 15 are arranged in a horizontal plane accessible to an operator standing on the walking path 11 (for example at a height of about 1 m 50 above the plane of this path 11).

Figure 6:
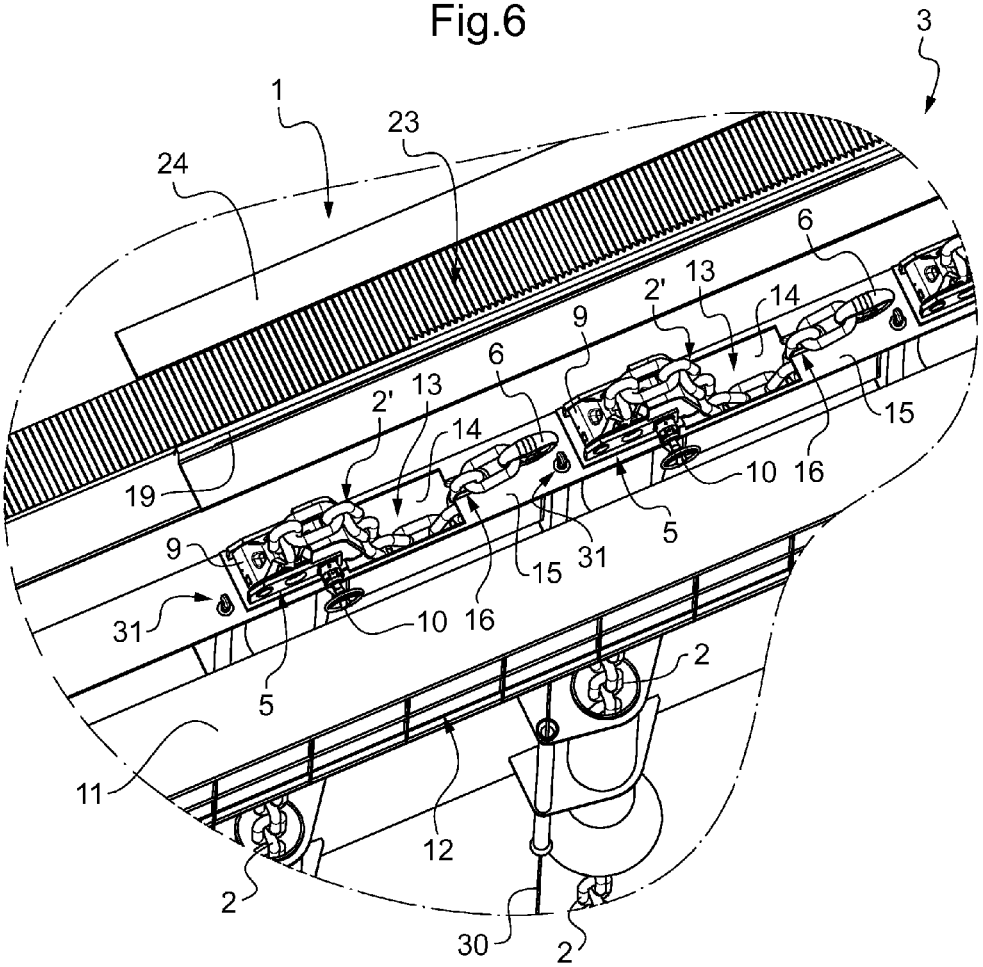
FIG. 6 is a further enlarged perspective view of a part of the anchor system illustrated in FIGS. 2 to 5, showing the detail of the chain stopper means.
Figure 7:
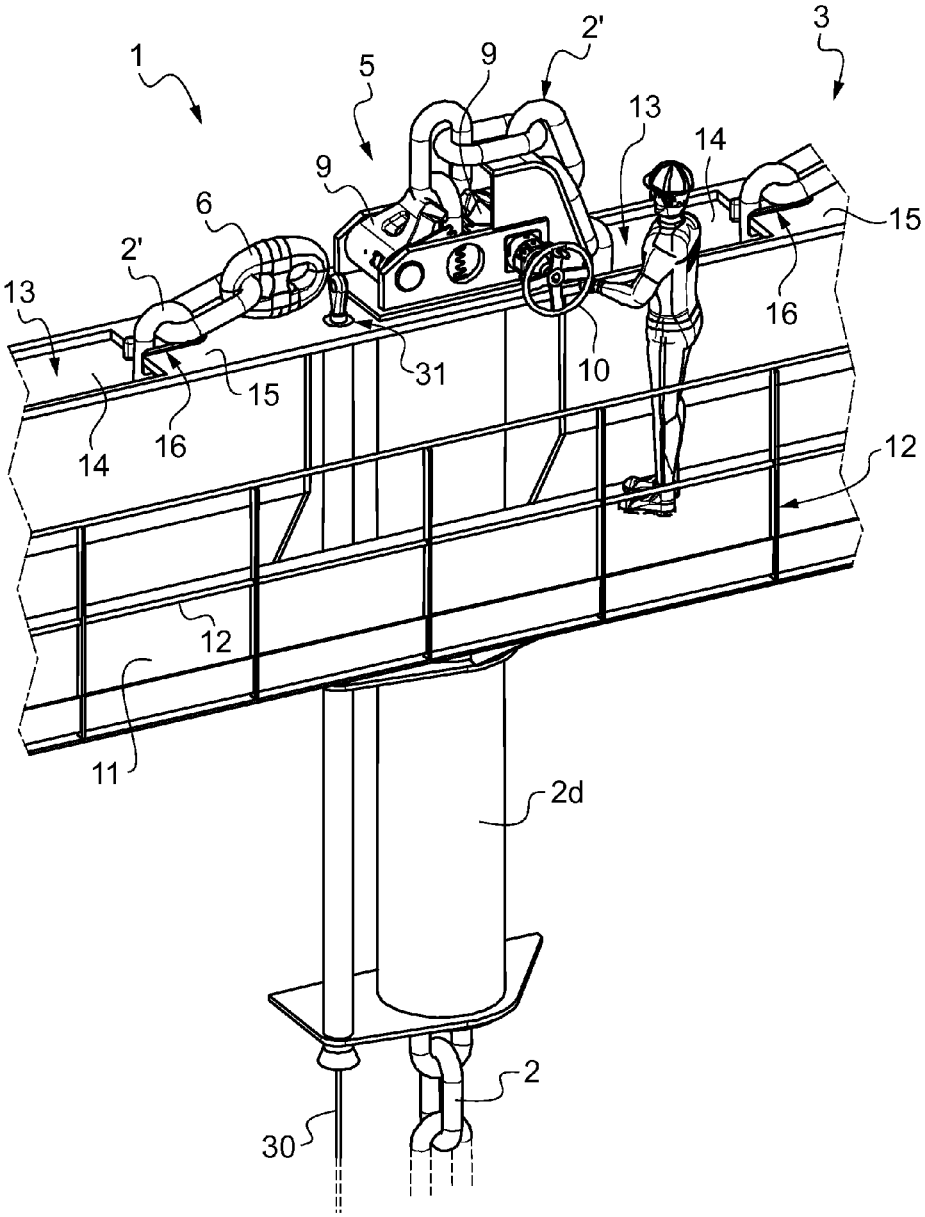
FIG. 7 shows the detail of FIG. 6, viewed according to another perspective.

As can be seen in particular in FIGS. 6 and 7, the bearing table 15 comprises a lateral notch 16, open opposite the opening 14 of the housing-reservoir 13. This notch 16, whose width is slightly higher than the thickness of the chain links, is adapted to permit the insertion of one of the chain links of the upstream chain strand 2', so as to lock the directly upstream chain link.

This way, the end connection chain link 6 can rest stably on the table 15 so as to permit an easy and ergonomic handling thereof by an operator, as will be described latter.

As illustrated in FIGS. 6 and 7, the chain link inserted in the notch 16 preferably corresponds to the third chain link of the upstream chain strand 2', from the connection chain link 6.

This connection chain link 6 is of the removable type (referred to as "Kenter chain link") for the removable attachment thereof to the downstream chain link of the downstream end of the master chain strand 8 of the tensioning winch 7, as described hereinafter.

The tensioning winch 7 consists for example in an electric winch, adapted to operate in the two directions the associated master chain strand 8.

This tensioning winch 7 is mounted on a rolling frame 18 guided by a rail structure 19 that is arranged along a rolling track 20 parallel to the horizontal line E of stopper means 5, for the moving thereof along this horizontal line E.

This moving of the tensioning winch 7, by the way of its rolling frame 18, is of the translational movement type.

The rotation axis 21 of the tensioning winch 7 extends parallel to the rolling track 20 and to the line E of stopper means 5.

At the anchor chains 2, the vertical downstream end 8' of the master chain strand 8 that cooperates with the tensioning winch 7 (at the exit or at the entrance of this winch according to the direction of rotation) extends in a vertical plane passing through the axes A of the chains 2, as well as through the stopper means 5 and the housings-reservoirs 13.

On the other side, the vertical upstream end 8" of the master chain strand 8 that cooperates with the tensioning winch 7 (at the exit or at the entrance according to the direction of rotation thereof) extends in a vertical plane passing through a container-reservoir 22, and in particular through the upper longitudinal opening 23 of this container-reservoir 22 arranged on the operating station 3 of the platform P.

The master chain strand 8 is made by means of an assembly of chain links identical or similar to those forming the anchor chains 2. The downstream chain link thereof (not visible in the figures), intended to cooperate with the connection chain link 6, is a standard chain link.

To save weight, the master chain strand 8 may be made with links whose wire diameter (for example 10 cm) in lower than the wire diameter (for example 18 cm) of the links of the anchor chains 2.

The container-reservoir 22, that is fixed, is delimited by a bottom and by side walls; the upper opening 23 thereof extends parallel to the rolling track 20, over the whole length or almost the whole length of the latter.

This upper opening 23 may comprise a sealing device provided with a mobile slot adapted for the passage of the master chain upstream strand 8", this sealing device being adapted for moving this mobile slot with the tensioning winch 7; this particular sealing device may consist of a succession of metal blades connected between them, and that are wound and unwound around cylinders located at the ends of the opening 23.

The rolling track 20 of the tensioning winch 7 is lined by a walking path 24 on which can walk an operator in charge of the move operations of this winch 7.

This walking path 24 is advantageously located on the other side of the longitudinal opening 23 of the container-reservoir 22 with respect to the rail structure 19 of the rolling track 20. For security reasons, this walking path 24 is advantageously lined with adapted protective guardrails (not shown).

As can be seen in particular in FIGS. 2 to 7, the rolling track 20 of the tensioning winch 7 is provided behind and above the line E of stopper means 5.

For the move operations thereof along the rolling track 20, the frame 18 of the tensioning winch 7 comprises driving means that herein consist in a pinion 26, associated with a motor carried by said frame 18, cooperating with a complementary rack 27 arranged over the whole length of the rail structure 19.

The operator can then control at will the motorized pinion 26, by means of an adapted control box, to move the tensioning winch 7 parallel to himself on the rolling track 20, and to position it correctly opposite one of the bearing tables 15 and/or one of the stopper means 5, so as to permit the operation of the opposite chain 2, after attachment of the master chain strand 8 to the connection chain link 6 of this chain 2.

For example, to re-tension a chain, the downstream chain link of the downstream end of the master chain strand 8 is attached to the connection chain link 6 of the upstream free strand 2' of the chain 2.

This operation, performed by one or two operators located on the walking path 11, is done on the bearing table 15, or just above the latter. The operator(s) can use for that purpose an additional electric winch 28, attached to the frame 18, and thus located above the bearing table 15 on which they works, adapted to help in lifting the connection chain link 6 and in facilitating the attachment thereof with the downstream chain link of the master chain 8.

Thereafter, once the connection of chains 2, 8 obtained, the operator operates the tensioning winch 7 in traction to absorb the chain slack; if not already made, he positions correctly the tensioning winch 7 so as to align the pulling strand thereof on the axis A of the associated anchor chain 2.

After deactivation of the stopper means 5 (by opening the grip jaws 9 by means of the operating wheel 10), the operator can adjust the tension of the chain 2 with the tensioning winch 7. Once the wanted tension obtained, the stopper means 5 are closed (active position) to lock the anchor chain 2, and the end connection chain link 6 thereof can be detached from the master chain strand 8.

The same operation can be performed successively on the different anchor chains 2 to be re-tensioned.

It is also understood that similar operations can be performed for the initial tensioning of the anchor chains 2, at the time when the anchor system 1 is mounted.

As an alternative, it will be noted that the fixed container-reservoir 22, ensuring the storage of the upstream end 8" of the master chain strand 8, may be replaced by a container-reservoir directly carried by the rolling frame 18 of the tensioning winch 7 (and which thus moves integral with this winch 7).

In the anchor system of the invention, the bending fairleads 4 also advantageously comprise their own chain stopper means (not visible in the figures), operated for activation or deactivation by a cable 30 whose operating end arrives at the level of the associated bearing table 15, locked by an upper stop provided with a hook 31 (FIGS. 6 and 7).

If need be, for example during re-tensioning operations of the chains 2, these stopper means of the fairleads 4 can be operated for deactivation, using the winch 28 (or another one) mounted on the frame 18 of the tensioning winch 7. For that purpose, the operator hitches the end of the winch 28 cable up to the hook 31 and operates this winch in traction, upwardly.

It is to be understood that the presence of a single tensioning winch substantially simplifies the general structure of the anchor system according to the invention, with reduced cost and reduced weight compared to the existing conventional systems.

The invention claimed is:

1. A ground anchor system for a floating platform (P), wherein said system (1) comprises at least one group (G) formed of a plurality of juxtaposed anchor chains (2), arranged parallel or substantially parallel to each other, and an operating station (3), the lower end (2*a*) of each of said chains (2) comprising means for fastening to the ground (S), the upper end (2*b*) thereof extending up to the operating station (3) arranged on said platform (P), above the waterline (F) thereof, and an intermediate area (2*c*) of each of said chains (2), between the lower (2*a*) and upper (2*b*) ends thereof, cooperating with a bending device (4) secured to said platform (P), advantageously under said waterline (F), wherein said operating station (3) comprise means (7) for tensioning said chains (2) and means (22) for storing the free end of said chains (2), upstream said tensioning means (7), characterized in that said operating station (3) comprises:

activatable/deactivatable stopper means (5) for each of said chains (2), for locking in position the associated chain (2) that ends by an upstream free strand (2') comprising an end connection chain link (6), wherein said stopper means (5) are arranged side by side, along a same line (E), and are each associated with one housing-reservoir (13) for the storage of said upstream free strand (2') of the associated chain (2), and tensioning means (7) common to the different chains (2), wherein said tensioning means comprise a single tensioning winch (7), movably mounted above said stopper means (5), parallel to said line (E) of stopper means (5), wherein said tensioning winch (7) comprises a master chain strand (8), whereof downstream end (8') comprises a downstream chain link adapted to be removably attached to the connection chain link (6) of the upstream free strand (2') of said anchor chains (2), and whereof upstream end (8") is stored in a container-reservoir (22).

2. The system according to claim 1, characterized in that the tensioning winch (7) is mounted on a rolling frame (18) guided by a rail structure (19) arranged on a rolling track (20) parallel to said line (E) of stopper means (5), wherein said rolling frame (18) is associated with driving means (26, 27) for moving it along said line (E) of stopper means (5), so as to position it above each of said stopper means (5), and to ensure the operation of the associated anchor chain (2), after connection of the downstream chain link of the master chain (8) of said tensioning winch (7) with the connection chain link (6) of said associated anchor chain (2).

3. The system according to claim 2, characterized in that the driving means of the rolling frame (18) of the tensioning winch (7) consist of a motorized pinion (26) integral with said rolling frame (18), cooperating with a rack (27) extending along said rolling track (20).

4. The system according to claim 3, characterized in that the rotation axis (21) of said tensioning winch (7) extends parallel to said rolling track (20), wherein the vertical downstream end (8') of said master chain strand (8) that cooperates with said tensioning winch (7) extends in a vertical plane passing through said stopper means (5) and through said associated housings-reservoirs (13), and the vertical upstream end (8") of said master chain strand (8) that cooperates with said tensioning winch (7) extends in a vertical plane passing through said associated storage container-reservoir (22).

5. The system according to claim 3, characterized in that the rolling frame (18) of the tensioning winch (7) carries said container-reservoir for the storage of the upstream end of said master chain strand (8).

6. The system according to claim 3, characterized in that the container-reservoir (22) for the storage of the upstream end (8") of said master chain strand (8) is fixedly mounted at the operating station (3) and extends over the whole length of said rolling track (20), wherein said container-reservoir (22) comprises an upper opening (23), for the passage of said master chain strand (8), that extends over the whole length, or almost the whole length, of said rolling track (20).

7. The system according to claim 2, characterized in that the rotation axis (21) of said tensioning winch (7) extends parallel to said rolling track (20), wherein the vertical downstream end (8') of said master chain strand (8) that cooperates with said tensioning winch (7) extends in a vertical plane passing through said stopper means (5) and through said associated housings-reservoirs (13), and the vertical upstream end (8") of said master chain strand (8) that cooperates with said tensioning winch (7) extends in a vertical plane passing through said associated storage container-reservoir (22).

8. The system according to claim 7, characterized in that the rolling frame (18) of the tensioning winch (7) carries said container-reservoir for the storage of the upstream end of said master chain strand (8).

9. The system according to claim 7, characterized in that the container-reservoir (22) for the storage of the upstream end (8") of said master chain strand (8) is fixedly mounted at the operating station (3) and extends over the whole length of said rolling track (20), wherein said container-reservoir (22) comprises an upper opening (23), for the passage of said master chain strand (8), that extends over the whole length, or almost the whole length, of said rolling track (20).

10. The system according to claim 2, characterized in that the rolling frame (18) of the tensioning winch (7) carries said container-reservoir for the storage of the upstream end of said master chain strand (8).

11. The system according to claim 2, characterized in that the container-reservoir (22) for the storage of the upstream end (8") of said master chain strand (8) is fixedly mounted at the operating station (3) and extends over the whole length of said rolling track (20), wherein said container-reservoir (22) comprises an upper opening (23), for the passage of said master chain strand (8), that extends over the whole length, or almost the whole length, of said rolling track (20).

12. The system according to claim 1, characterized in that the housings-reservoirs (13) for the storage of the upstream free strands (2') of the anchor chains (2) are arranged in the plane of the line (E) of stopper means (5).

13. The system according to claim 12, characterized in that each housing-reservoir (13) for the storage of the upstream free strand (2') of the anchor chains (2) comprises an upper opening (14) associated with a lateral bearing table (15), arranged in the continuation of said upper opening (14), wherein said bearing table (15) comprises a notch (16), open opposite said opening (14), for the passage of a chain link of said upstream free chain strand (2'), and the locking of the directly upstream chain link, bearing on said table (15).

14. The system according to claim 1, characterized in that the connection chain link (6) of the upstream free strand (2') of the anchor chains (2) consists in a removable chain link.

15. The system according to claim 1, characterized in that the tensioning winch (7) in mounted on a rolling frame (18) that carries an additional winch (28), for example for the operation of said connection chain link (6) and/or of stopper means arranged on said bending devices (4).

* * * * *